US009439507B2

(12) United States Patent
Liu

(10) Patent No.: US 9,439,507 B2
(45) Date of Patent: Sep. 13, 2016

(54) TOOL CABINET

(71) Applicant: Chia-Ming Liu, Dou-Lio (TW)
(72) Inventor: Chia-Ming Liu, Dou-Lio (TW)
(73) Assignee: Chia-Ming Liu, Duo-Lio (TW)

( * ) Notice: Subject to any disclaimer, the term of this patent is extended or adjusted under 35 U.S.C. 154(b) by 0 days.
(21) Appl. No.: 14/716,977
(22) Filed: May 20, 2015
(65) Prior Publication Data
US 2016/0198852 A1 Jul. 14, 2016
(30) Foreign Application Priority Data
Jan. 14, 2015 (CN) ..... 2015 2 0024419
(51) Int. Cl.
*A47B 46/00* (2006.01)
*A47B 83/00* (2006.01)
*A47B 37/00* (2006.01)
*A47B 13/00* (2006.01)
*A47B 9/04* (2006.01)
*A47B 96/18* (2006.01)
*A47B 17/02* (2006.01)
(52) U.S. Cl.
CPC ..... *A47B 83/00* (2013.01); *A47B 9/04* (2013.01); *A47B 13/00* (2013.01); *A47B 37/00* (2013.01); *A47B 96/18* (2013.01); *A47B 17/02* (2013.01); *A47B 2009/046* (2013.01)
(58) Field of Classification Search
CPC ..... A47B 9/04; A47B 13/00; A47B 37/00; A47B 45/00; A47B 46/00; A47B 83/00; A47B 96/18; A47B 17/02
USPC ..... 312/196, 223.2, 306, 312, 317.3, 319.5, 312/902; 108/59, 106, 147.19
See application file for complete search history.

(56) References Cited

U.S. PATENT DOCUMENTS 654,922 A * 7/1900 Schipkowsky ..... A47B 17/036 312/196
742,118 A * 10/1903 Huddleston ..... A47B 31/00 108/17
1,099,521 A * 6/1914 Sprung ..... E05B 65/0003 312/196
1,247,590 A * 11/1917 Sprung ..... A47B 51/00 312/196
1,459,930 A * 6/1923 Riehle ..... B25H 1/04 144/285
2,019,455 A * 10/1935 Lehman ..... A47B 17/02 312/196
2,931,685 A * 4/1960 Harold ..... A47B 17/02 108/32
3,245,741 A * 4/1966 Bartlett ..... A47B 17/02 312/196
3,297,387 A * 1/1967 Parsons ..... A47B 29/00 112/217.1
4,740,044 A * 4/1988 Taylor ..... A47B 21/03 312/196
6,213,575 B1 * 4/2001 Brin, Jr. ..... A47B 77/04 108/147
6,312,069 B1 * 11/2001 Weng ..... A47B 9/06 108/147
8,033,620 B2 * 10/2011 Retchloff ..... B25H 3/00 312/290
2002/0101139 A1 * 8/2002 Lee ..... A47B 21/0073 312/196
2005/0046315 A1 * 3/2005 Doane ..... A47B 17/02 312/196
2012/0025681 A1 * 2/2012 Ton ..... A47B 46/00 312/309

* cited by examiner

*Primary Examiner* — James O Hansen
(74) *Attorney, Agent, or Firm* — Trop Pruner & Hu, P.C.

(57) ABSTRACT

A tool cabinet includes a cabinet housing, drawers disposed in the cabinet housing, two sideboards, a working platform unit, two slide rails, two lifting units, a linkage unit, a drive unit and reinforcement ribs. Each of the sideboards cooperates with the cabinet housing to define a receiving space. Each of the reinforcement ribs extends from a respective one of opposite sides of the cabinet housing toward the respective one of the sideboards. The linkage unit interconnects the lifting units. The drive unit is drivingly connected to one of the lifting units, and is operable to drive synchronized movements of the lifting units to move the working platform along the slide rails.

10 Claims, 5 Drawing Sheets

TOOL CABINET

CROSS-REFERENCE TO RELATED APPLICATION

This application claims priority to Chinese Application No. 201520024419.0, filed on Jan. 14, 2015.

FIELD

The disclosure relates to a cabinet, and more particularly to a tool cabinet.

BACKGROUND

A conventional tool cabinet includes a cabinet body and a plurality of drawers that are vertically stacked one above the other in the cabinet body. The conventional tool cabinet is used for storing and systematizing items stored in the drawers, such as files, hand tools, power tools, and so on, in a ready-to-use manner. However, since the tools stored in the conventional tool cabinet are generally made of a relatively heavy metal material, the overall weight of the conventional tool cabinet may be heavily increased. As a result, when the conventional tool cabinet collides with a wall, the collision may cause damage to the conventional tool cabinet.

SUMMARY

Therefore, an object of the disclosure is to provide a tool cabinet that can alleviate the drawback of the prior arts.

According to the disclosure, the tool cabinet includes a cabinet housing that includes a top cover, a plurality of drawers that are movably disposed in the cabinet housing, two sideboards, a working platform unit, two slide rails, two lifting units, a linkage unit, a drive unit, and a plurality of reinforcement ribs.

The sideboards are respectively coupled to two opposite sides of the cabinet housing. Each of the sideboards cooperates with a respective one of the sides of the cabinet housing to define a receiving space.

The working platform unit has a platform member disposed above the top cover, and two extension members extending respectively and downwardly from two opposite ends of the platform member through the top cover and extending respectively and slidably into the receiving spaces.

The slide rails are respectively disposed in the receiving spaces. Each of the slide rails extends from a respective one of the opposite sides of the cabinet housing toward a respective one of the sideboards. The extension members engage respectively and slidably the slide rails.

The lifting units extend upwardly, respectively and movably from the receiving spaces, and are connected to the working platform.

The linkage unit interconnects the lifting units and synchronizes movement of the lifting units.

The drive unit is drivingly connected to one of the lifting units, and is operable to drive synchronized movements of the lifting units to move the working platform along the slide rails.

The reinforcement ribs are respectively disposed in the receiving spaces. Each of the reinforcement ribs extends from the respective one of the opposite sides of the cabinet housing toward the respective one of the sideboards.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
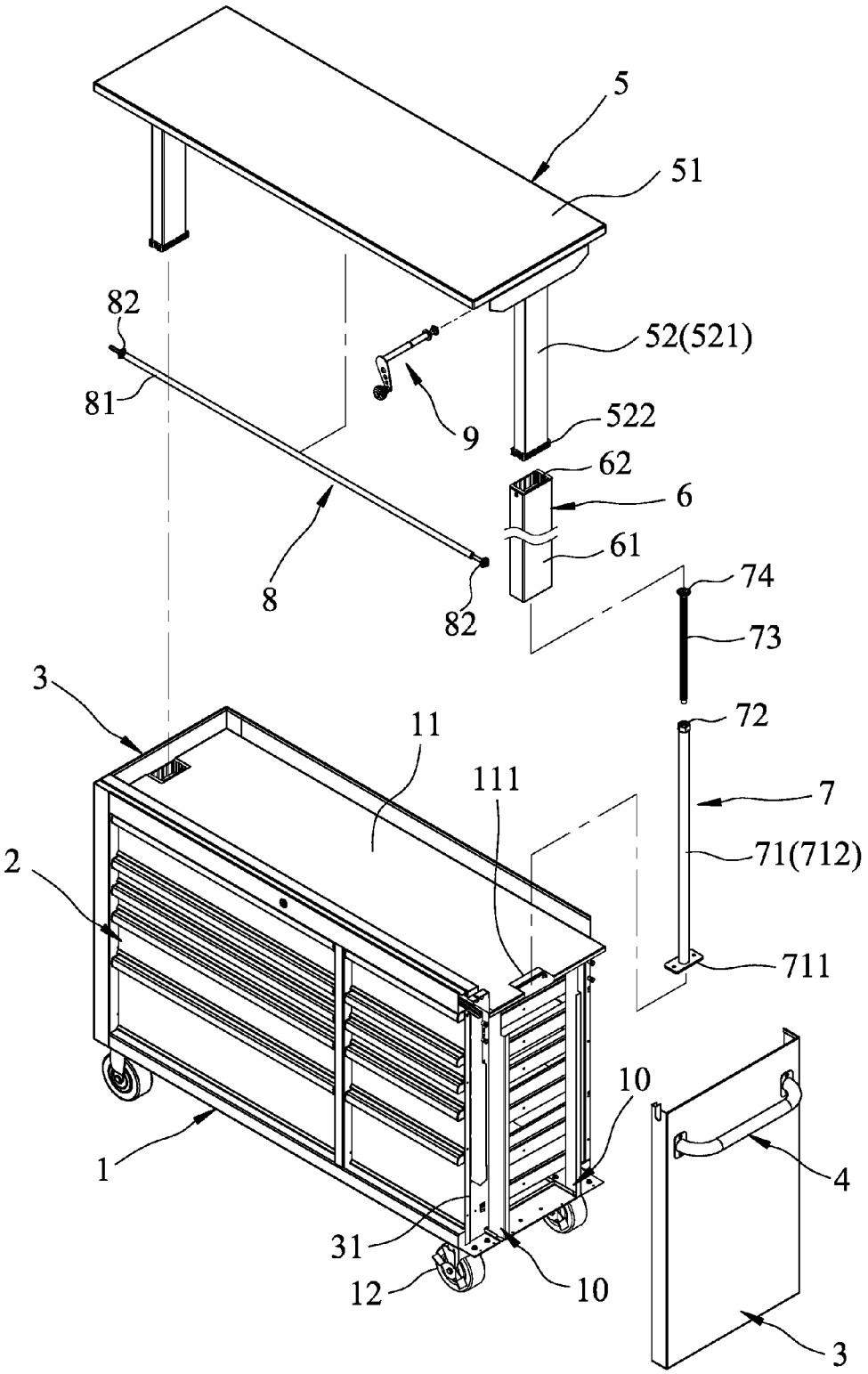
FIG. 1 is a fragmentary partly exploded perspective view illustrating an embodiment of a tool cabinet according to the disclosure.
Figure 2:
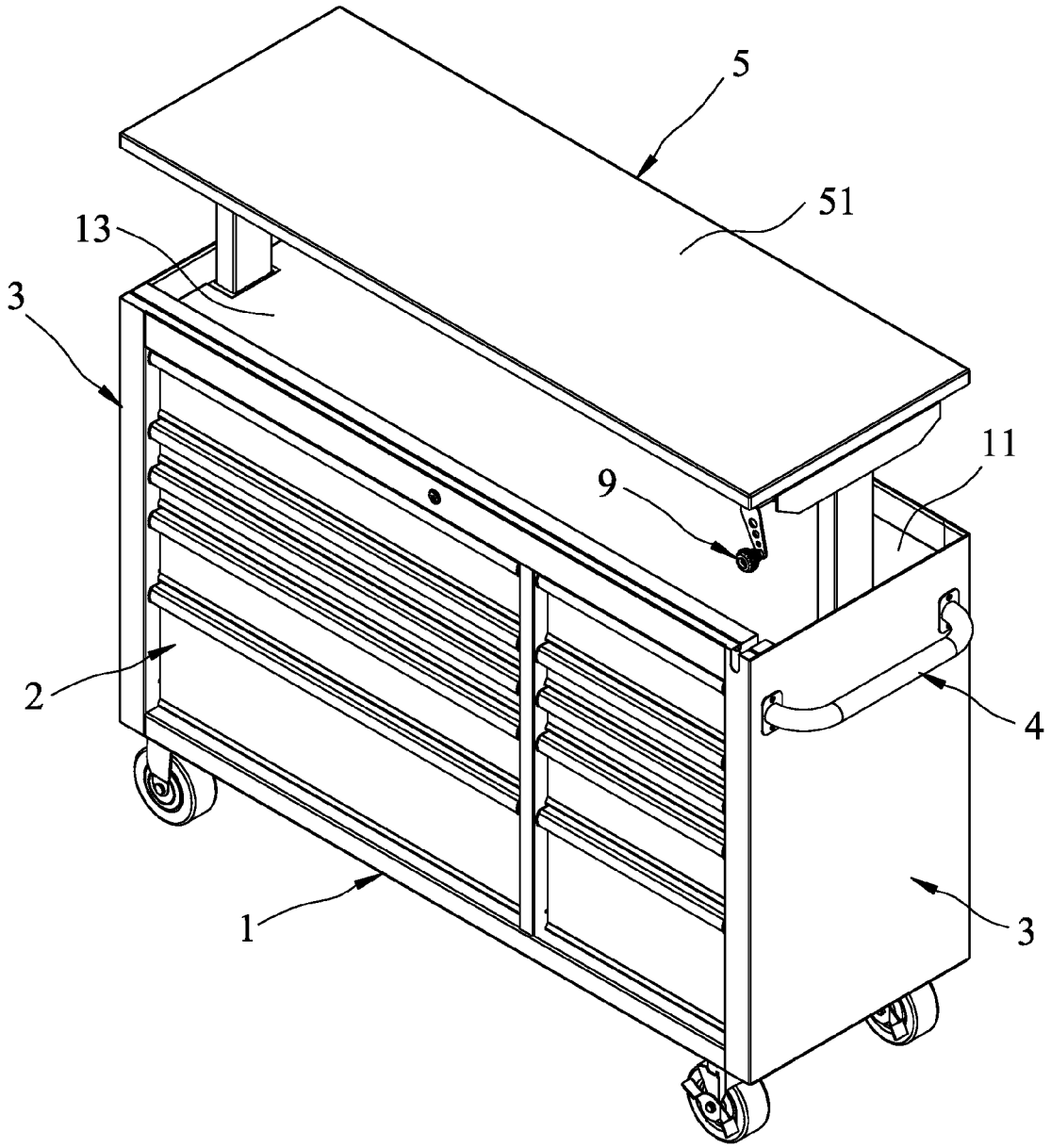
FIG. 2 is an assembled perspective view of the embodiment illustrating a working platform unit when lifted upward from a top cover.
Figure 3:
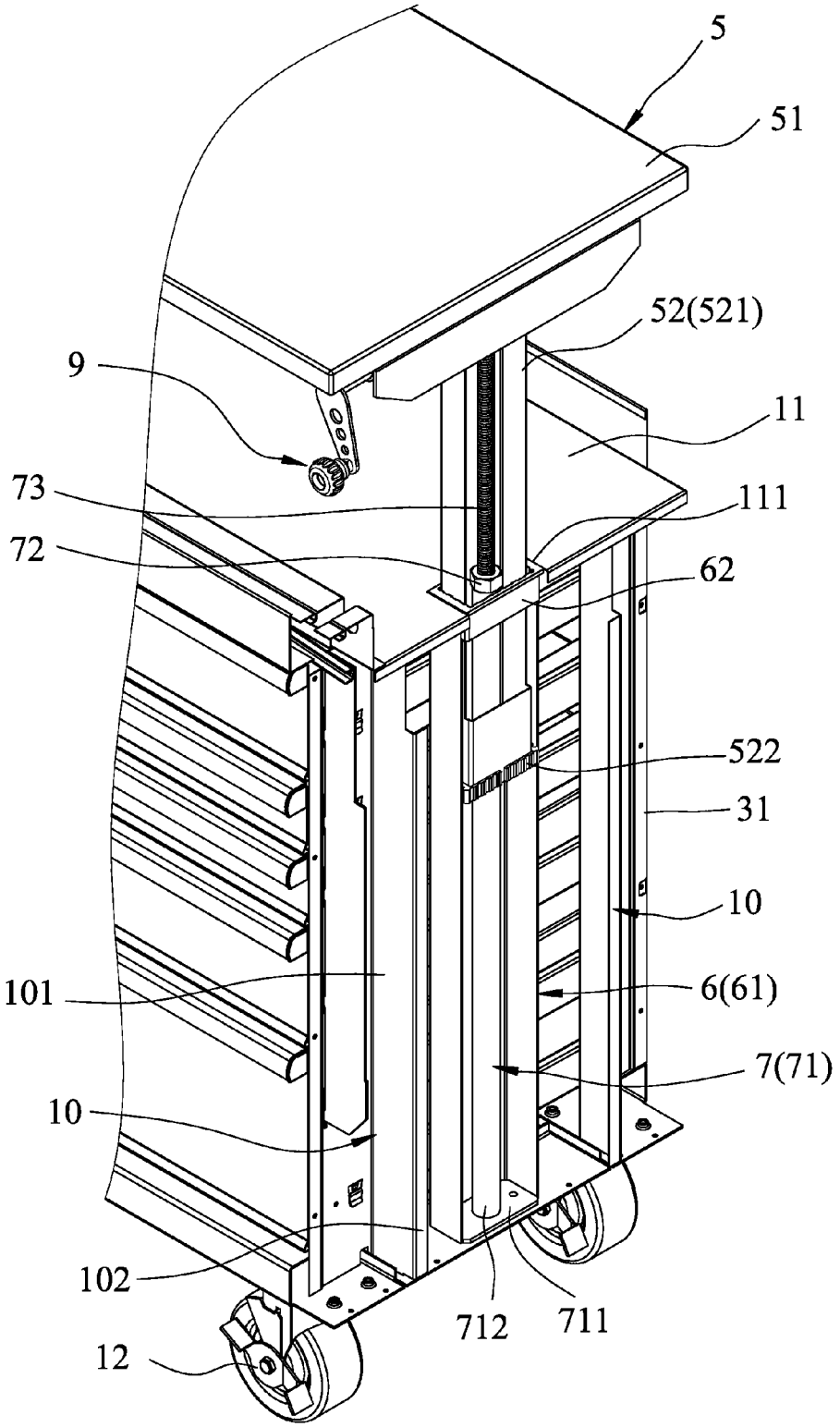
FIG. 3 is a fragmentary perspective view of the embodiment with a sideboard being omitted.
Figure 4:
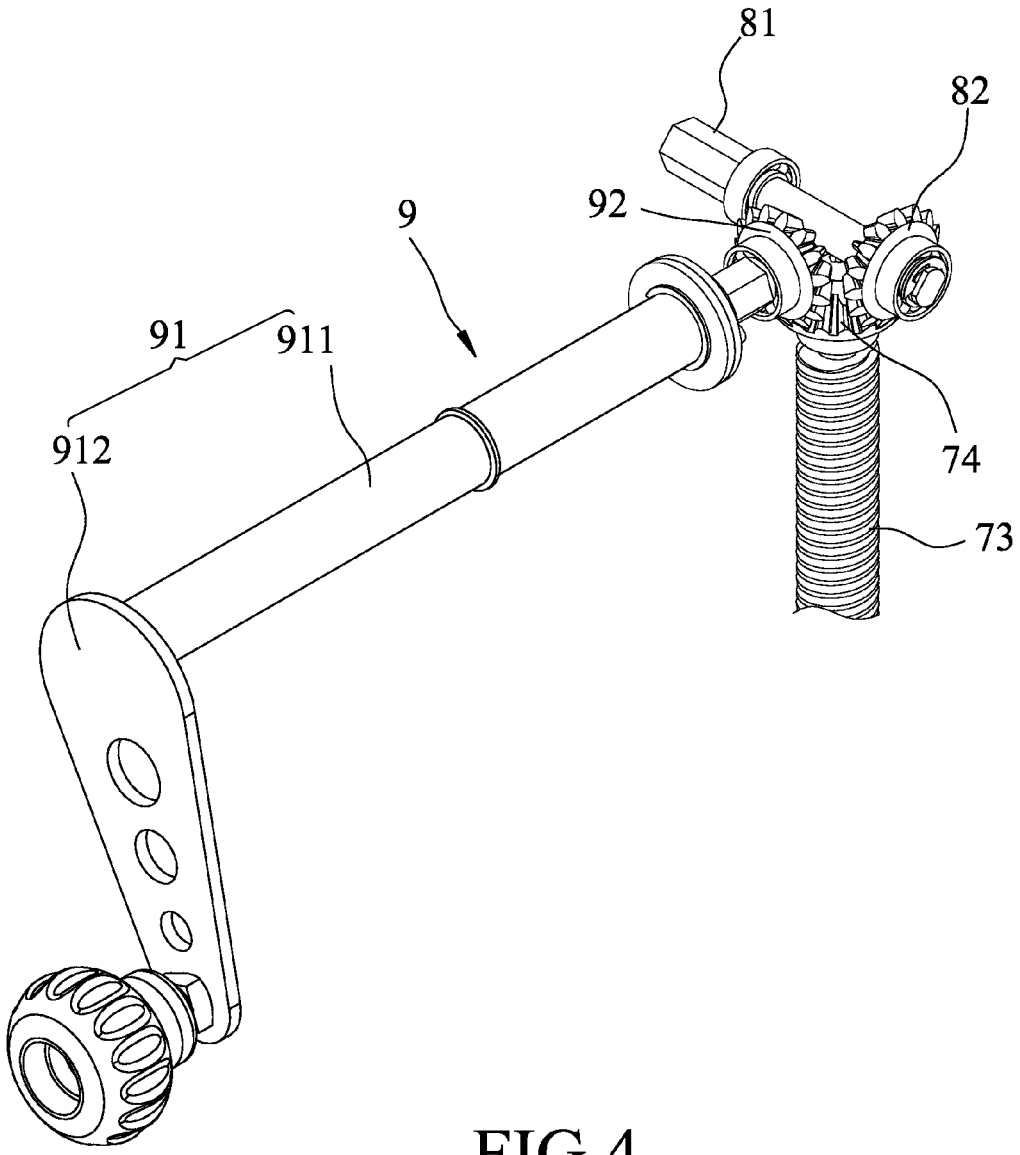
FIG. 4 is a fragmentary enlarged perspective view illustrating a drive unit, a lifting unit and a linkage unit of the embodiment.

Referring to FIGS. 1 to 4, an embodiment of a tool cabinet according to the disclosure is illustrated. The tool cabinet includes a cabinet housing 1, a plurality of drawers 2, two sideboards 3, a grip bar 4, a working platform unit 5, two slide rails 6, two lifting units 7, a linkage unit 8, a drive unit 9, a plurality of reinforcement ribs 10 and a plurality of caster units 12.

The cabinet housing 1 includes a top cover 11 that is formed with two through holes 111. The caster units 12 are disposed below and connected to a bottom end of the housing 1.

The drawers 2 are movably disposed in the cabinet housing 1.

The sideboards 3 are respectively coupled to two opposite sides of the cabinet housing 1. Each of the sideboards 3 cooperates with a respective one of the sides of the cabinet housing 1 to define a receiving space 31 therebetween.

The grip bar 4 is mounted on one of the sideboards 3.

The working platform unit 5 has a platform member 51 disposed above the top cover 11, and two extension members 52 extending respectively and downwardly from two opposite ends of the platform member 51 through the top cover 11 and extending respectively and slidably into the receiving spaces 31. Each of the extension members 52 has a main portion 521 that extends downwardly from a respective one of the two opposite ends of the platform member 51 and that has a rectangular cross-section, and an engaging portion 522 that surrounds and protrudes from a bottom end of the main portion 521.

The slide rails 6 are respectively disposed in the receiving spaces 31 and respectively extend through the through holes 111. Each of the slide rails 6 extends from a respective one of the opposite sides of the cabinet housing 1 toward a respective one of the sideboards 3. In this embodiment, each of the extension members 52 engages respectively, slidably and fittingly into the slide rails 6. Each of the slide rails 6 has a slide portion 61 that has a rectangular cross-section and that has an inner surface abutting against the main portion 521 of a respective one of the extension members 52, and an abutment portion 62 that is connected to a top end of the slide portion 61, that surrounds and abuts against the main portion 521 of the respective one of the extension members 52, and that retains the engaging portion 522 of the respective one of extension members 52 within the slide portion 61. In this embodiment, the abutment portions 62 of the slide rails 6 are respectively disposed in the through holes 111 and are flush with a top surface of the top cover 11.

The lifting units 7 extend upwardly, respectively and movably from the receiving spaces 31, and are connected to the working platform 5. In addition, each of the lifting units 7 has a guide tube 71 that is disposed in a respective one of the slide rails 6, a nut 72 that is disposed on a top end of the guide tube 71, a threaded rod 73 that is threadedly connected to the nut 72 and that has a top end connected to the platform member 51 and an opposite end inserted telescopically into the guide tube 71, and a transmission bevel gear 74 that is fixedly disposed on the top end of the threaded rod 73. In this embodiment, the guide tube 71 has a support portion 711 that is connected to the bottom end of the cabinet housing 1, and a tube portion 712 that extends upwardly from the support portion 711.

The linkage unit 8 interconnects the lifting units 7 and synchronizes movement of the lifting units 7. In this embodiment, the linkage unit 8 includes a linkage rod 81 that is disposed below the platform member 51, that extends along a horizontal axis, and that is rotatable about the horizontal axis, and two linkage bevel gears 82 that are respectively connected to two opposite ends of the linkage rod 81 and that respectively mesh with the transmission bevel gears 74 of the lifting units 7.

The drive unit 9 is drivingly connected to one of the lifting units 7, and is operable to drive synchronized movements of the lifting units 7 to move the working platform 5 along the slide rails 6. In this embodiment, the drive unit 9 includes a crank member 91 that is mounted to the working platform unit 5 and that is connected to the transmission bevel gear 74 of the one of the lifting units 7, and a drive bevel gear 92 that is connected to an end of the crank member 91 and that meshes with the transmission bevel gear 74 of the one of the lifting units 7. In addition, the drive member 91 has a rotatable connection portion 911 that is mounted to the working platform unit 5 and that has the end of the drive member 91 to which the drive bevel gear 92 is connected, and a handle portion 912 that is connected to the connection portion 911 and that is opposite to the drive bevel gear 92. Moreover, particularly, the handle portion 912 transversely extends from an end of the connection portion 911 opposite to the drive bevel gear 92. In such an arrangement, a user can hold and turn the handle portion 912 to rotate the connection portion 911 for synchronizing movements of the lifting units 7 to move the working platform 5 along the slide rails 6.

The reinforcement ribs 10 are respectively disposed in the receiving spaces 31. Each of the reinforcement ribs 10 extends from the respective one of the opposite sides of the cabinet housing 1 toward the respective one of the sideboards 3. Each of the reinforcement ribs 10 has a rib body 101 extending from the respective one of the opposite sides of the cabinet housing 1 toward the respective one of the sideboards 3, and a contact portion 102 perpendicular to the rib body 101 and abutting against the respective one of the sideboards 3.

Since the reinforcement ribs 10 are respectively disposed in the receiving spaces 31, the structural strength at the sideboards 3 can thereby be reinforced. In addition, since the slide rails 6 are respectively disposed in the receiving spaces 31, lateral sides of the tool cabinet can be further reinforced. Furthermore, the working platform unit 5 can be stably moved relative to the cabinet housing 1 by virtue of the engagement between the extension members 52 and slide rails 6.

In order to move the working platform unit 5, the handle portion 912 is first turned to drive the connection portion 911 to rotate, so that the drive bevel gear 92 is rotated together with the connection portion 911. Since the drive bevel gear 92 meshes with the transmission bevel gear 74 of the one of the lifting units 7, when the one of the lifting units 7 is driven to rotate, the linkage unit 8 is thereby driven to synchronize the movement of the lifting units 7. As such, the working platform unit 5 is stably moved along the slide rails 6.

Figure 5:
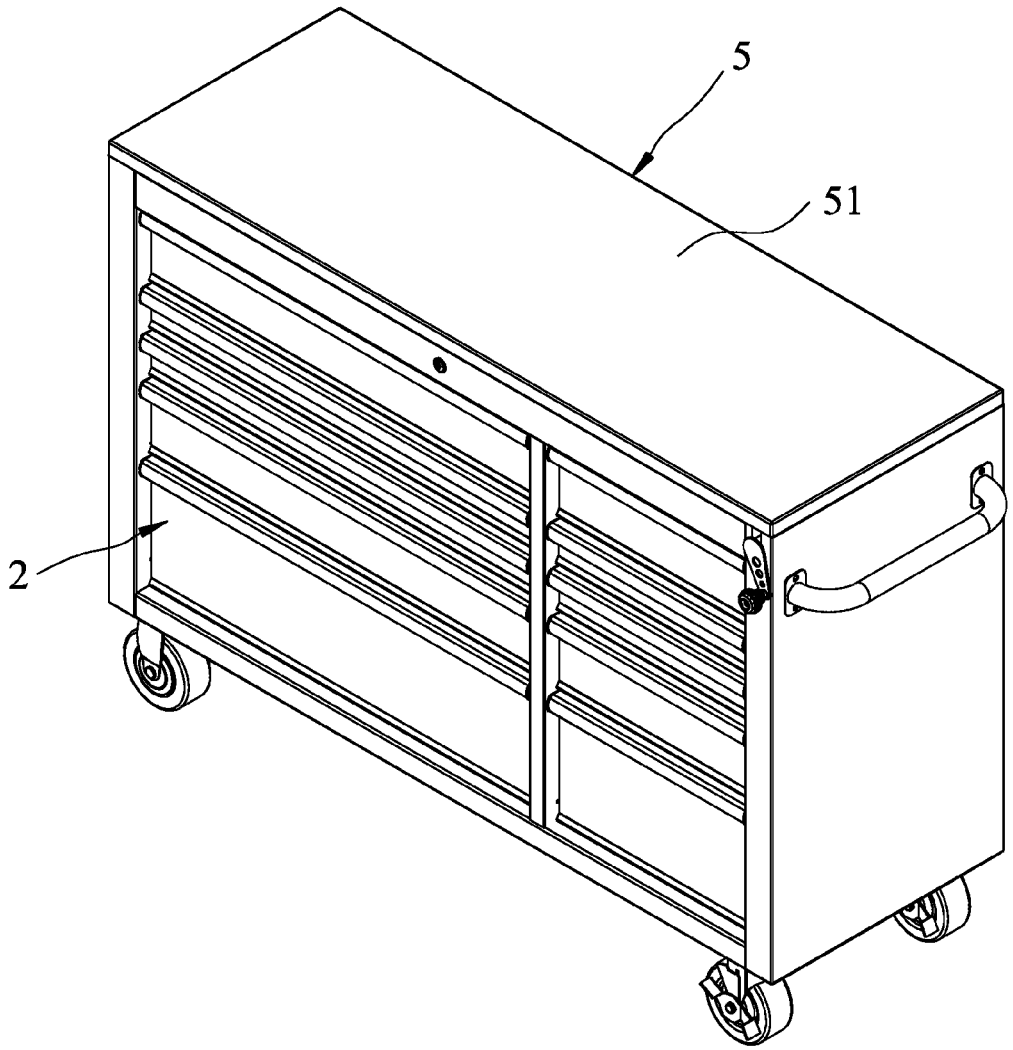
FIG. 5 is an assembled perspective view of the embodiment when the working platform is lowered downward to the top cover.

Referring back to FIGS. 2 and 5, when the working platform unit 5 is lifted, the platform member 51 and the top cover 11 cooperatively define an expansion space 13 that is capable of accommodating tools. Therefore, by lifting the working platform unit 5 (see FIG. 2) when the drawers 2 are full, additional tools can be conveniently stored in the expansion space 13. In addition, tools can be taken out from the drawers 2 and placed in the expansion space 13 in advance for the user's easy access. As shown in FIG. 5, when the expansion space 13 is no longer needed, the working platform unit 5 can be moved downwardly to rest against the top cover 11.

To sum up, the tool cabinet of the disclosure not only has the reinforcement ribs 10 and the slide rails 6 for reinforcing the lateral sides of the cabinet housing 1 to sustain lateral collision, but is also operable to move the working platform unit 5 via operation of the slide rails 6, the lifting units 7, the linkage unit 8 and the drive unit 9.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A tool cabinet comprising:

a cabinet housing that includes a top cover;

a plurality of drawers that are movably disposed in said cabinet housing;

two sideboards that are respectively coupled to two opposite sides of said cabinet housing, each of said sideboards cooperating with a respective one of said sides of said cabinet housing to define a receiving space;

a working platform unit that has a platform member disposed above said top cover, and two extension members extending respectively and downwardly from two opposite ends of said platform member through said top cover and extending respectively and slidably into said receiving spaces;

two slide rails that are respectively disposed in said receiving spaces, each of said slide rails extending from a respective one of said opposite sides of said cabinet housing toward a respective one of said sideboards, said extension members engaging respectively and slidably said slide rails;

two lifting units that extend upwardly, respectively and movably from said receiving spaces, and that are connected to said working platform;

a linkage unit that interconnects said lifting units and that synchronizes movement of said lifting units;

a drive unit that is drivingly connected to one of said lifting units, and that is operable to drive synchronized movements of said lifting units to move said working platform along said slide rails; and a plurality of reinforcement ribs that are respectively disposed in said receiving spaces, each of said reinforcement ribs extending from the respective one of said opposite sides of said cabinet housing toward the respective one of said sideboards.

2. The tool cabinet as claimed in claim 1, wherein each of said extension members has a rectangular cross-section and engages respectively, slidably and fittingly into said slide rails.

3. The tool cabinet as claimed in claim 2, wherein:

each of said extension members has a main portion that extends downwardly from a respective one of the two opposite ends of said platform member, and an engaging portion that surrounds and protrudes from a bottom end of said main portion; and each of said slide rails has a slide portion that has a rectangular cross-section and that has an inner surface abutting against said main portion of a respective one of said extension members, and an abutment portion that is connected to a top end of said slide portion, that surrounds and abuts against said main portion of the respective one of said extension members, and that retains said engaging portion of the respective one of extension members within said slide portion.

4. The tool cabinet as claimed in claim 3, wherein:

said top cover is formed with two through holes; and said abutment portions of said slide rails are respectively disposed in said through holes and are flush with a top surface of said top cover.

5. The tool cabinet as claimed in claim 1, wherein each of said reinforcement ribs has a rib body extending from the respective one of said opposite sides of said cabinet housing toward the respective one of said sideboards, and a contact portion perpendicular to said rib body and abutting against the respective one of said sideboards.

6. The tool cabinet as claimed in claim 1, wherein:

each of said lifting units has a guide tube that is disposed in a respective one of said slide rails, a nut that is disposed on a top end of said guide tube, a threaded rod that is threadedly connected to said nut and that has a top end connected to said platform member and an opposite end inserted telescopically into said guide tube, and a transmission bevel gear that is fixedly disposed on said top end of said threaded rod;

said linkage unit includes a linkage rod that is disposed below said platform member, that extends along a horizontal axis, and that is rotatable about the horizontal axis, and two linkage bevel gears that are respectively connected to two opposite ends of said linkage rod and that respectively mesh with said transmission bevel gears of said lifting units; and said drive unit includes a crank member that is mounted to said working platform unit and that is connected to said transmission bevel gear of the one of said lifting units.

7. The tool cabinet as claimed in claim 6, wherein said guide tube has a support portion that is connected to a bottom end of said cabinet housing, and a tube portion that extends upwardly from said support portion.

8. The tool cabinet as claimed in claim 6, wherein said drive unit further includes a drive bevel gear that is connected to an end of said crank member and that meshes with said transmission bevel gear of the one of said lifting units.

9. The tool cabinet as claimed in claim 8, wherein said drive member has a rotatable connection portion that is mounted to said working platform unit and that has said end of said drive member to which said drive bevel gear is connected, and a handle portion that is connected to said connection portion and that is opposite to said drive bevel gear.

10. The tool cabinet as claimed in claim 1, further comprising a grip bar that is mounted on one of said sideboards and a caster unit that is disposed below and connected to a bottom end of said housing.

* * * * *